US007513783B2

(12) United States Patent
Okuda et al.

(10) Patent No.: US 7,513,783 B2
(45) Date of Patent: Apr. 7, 2009

(54) CONNECTOR WITH A ROTATABLE LEVER WITH A RECESS WITH A SPRING

(75) Inventors: Katsumasa Okuda, Tokyo (JP); Satoru Majima, Tokyo (JP); Hidenori Aizawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 27 days.

(21) Appl. No.: 11/900,373

(22) Filed: Sep. 11, 2007

(65) Prior Publication Data

US 2008/0064243 A1 Mar. 13, 2008

(30) Foreign Application Priority Data

Sep. 12, 2006 (JP) ..... 2006-246900

(51) Int. Cl.
*H01R 13/62* (2006.01)

(52) U.S. Cl. ..... 439/157

(58) Field of Classification Search ..... 439/157, 439/152, 160, 159, 372
See application file for complete search history.

(56) References Cited

U.S. PATENT DOCUMENTS 5,790,373 A * 8/1998 Kim et al. ..... 361/685
5,957,710 A * 9/1999 Nagano ..... 439/157
6,019,620 A * 2/2000 Kodama et al. ..... 439/157
6,183,277 B1 * 2/2001 Okabe et al. ..... 439/157
6,733,313 B2 5/2004 Shinozaki et al.
2006/0281351 A1 12/2006 Yamaoka

FOREIGN PATENT DOCUMENTS

JP 2000-323231 11/2000
JP 2003-036929 2/2003
JP 2003-249305 9/2003
JP 2006-120588 5/2006

OTHER PUBLICATIONS

Japanese Office Action dated Jul. 2, 2008.
UK Search Report dated Dec. 12, 2007.

* cited by examiner

*Primary Examiner*—Chandrika Prasad
(74) *Attorney, Agent, or Firm*—Collard & Roe, P.C.

(57) ABSTRACT

In a connector including a housing to be fitted to a mating connector and a lever rotatable to the housing between a first and a second position, a main body of the lever has a generally flat shape and provided with a recess recessed from a principal surface of the main body in a thickness direction to have a bottom portion. A spring portion extends from the main body in the recess to have a free end and being elastically deformable in the thickness direction. A locking portion is formed to the spring portion at a first portion away from the free end and adapted to be locked with the housing when the lever is at the second position. The spring portion faces the bottom of the recess with a distance greater at a second portion between the free end and the first portion than that at the first portion.

7 Claims, 6 Drawing Sheets

CONNECTOR WITH A ROTATABLE LEVER WITH A RECESS WITH A SPRING

This application is based upon and claims the benefit of priority from Japanese patent application No. 2006-246900, filed on Sep. 12, 2006, the disclosure of which is incorporated herein in its entirety by reference.

TECHNICAL FIELD

This invention relates to a connector including a lever rotatable to a connector housing between a first and a second position.

BACKGROUND ART

An electrical connector of the type is disclosed in Japanese Unexamined Patent Application Publication (JP-A) No. 2003-249305 (corresp. to U.S. Pat. No. 6,733,313) as a lever-type connector and has a rotatable lever. The lever has a resilient lock member formed at its one end for locking the lever at a fitting position and a finger placing portion formed adjacent to the resilient lock member for rotating the lever.

However, in the lever-type connector, a lower side of the resilient lock member of the lever is opened so that mechanical strength is insufficient. Accordingly, when the resilient lock member is pressed and operated, the lever may be deformed and an operation force of the lever may not be reliably transmitted to a mating connector.

In case where the connector has a large number of contacts, the lever is inevitably increased in size. Therefore, protrusion of the lever before fitting is large and flapping strength is decreased.

SUMMARY OF THE INVENTION

It is therefore an exemplary object of this invention to provide a connector capable of reliably transmitting an operation force of a lever.

Other objects of the present invention will become clear as the description proceeds.

According to an exemplary aspect of the present invention, there is provided a connector comprising a housing adapted to be fitted to a mating connector and a lever held by the housing and rotatable between a first position where the housing is capable of being fitted to and released from the mating connector and a second position where the housing is fitted to the mating connector, wherein the lever comprises a main body having a generally flat shape and provided with a recess which is recessed from a principal surface of the main body in a thickness direction to have a bottom portion, a spring portion which extends from the main body in the recess to have a free end and which is elastically deformable in the thickness direction, and a locking portion which is formed to the spring portion at a first portion away from the free end and which is adapted to be locked with the housing when the lever is at the second position, wherein the spring portion faces the bottom of the recess with a distance which is greater at a second portion between the free end and the first portion than that at the first portion.

EXEMPLARY EMBODIMENT

Figure 1:
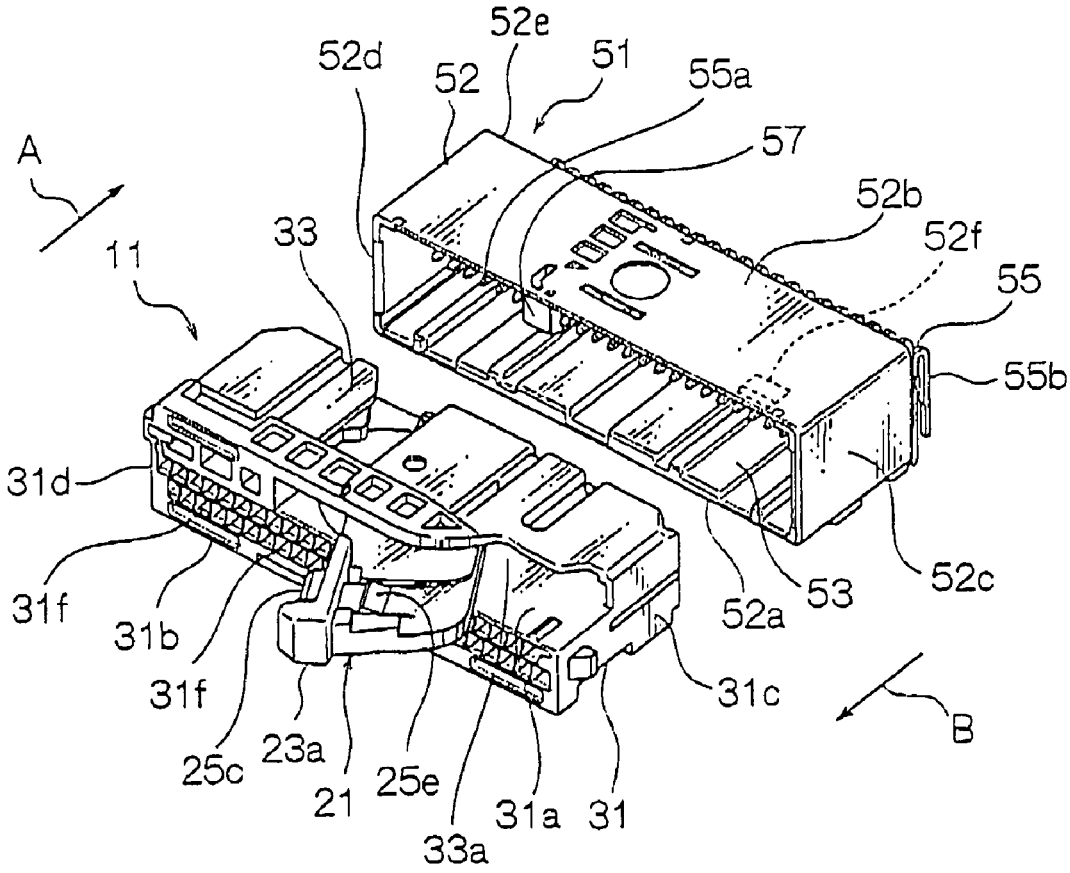
FIG. 1 is a perspective view of a connector according to an exemplary embodiment of this invention, together with a mating connector, in a state before the connector is fitted to the mating connector.
Figure 2:
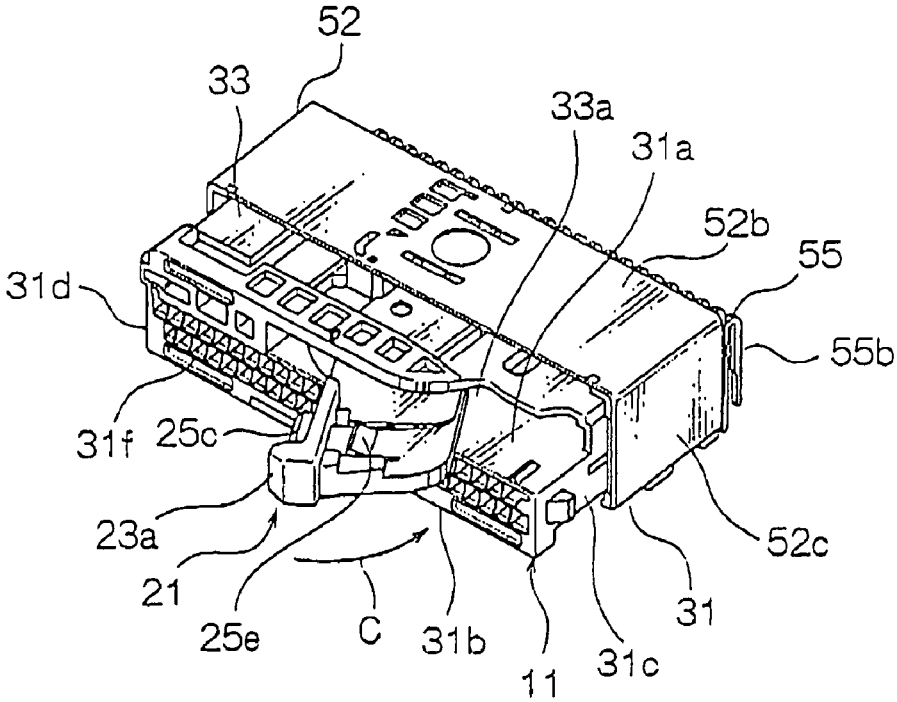
FIG. 2 is a perspective view of the connector in a state immediately before the connector is fitted to the mating connector.
Figure 3:
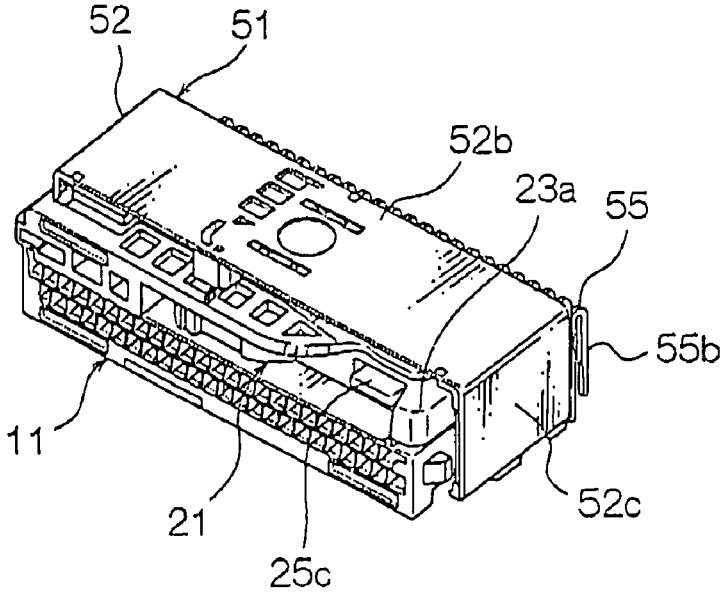
FIG. 3 is a perspective view of the connector in a state after the connector is fitted to the mating connector.

Referring to FIGS. 1 to 3, a connector 11 according to an exemplary embodiment includes a lever 21 adapted to be engaged with a mating connector 51, a housing 31 to which the lever 21 is mounted, and a plurality of contacts (not shown) held by the housing 31. The connector 11 is a plug connector and the mating connector 51 is a receptacle connector mounted to a printed wiring board. The connector 11 is fitted to the mating connector 51 in a fitting direction A (depicted by an arrow A in FIG. 1). When the connector 11 in a fitted state is moved in a removing direction B (depicted by an arrow B in FIG. 1) with respect to the mating connector 51, the connector 11 is removed from the mating connector 51.

The connector 11 and the mating connector 51 are fitted and connected to each other by rotating the lever 21 rotatably mounted to the housing 31. The lever 21 is rotatably held by the housing 31 between a first position (initial position illustrated in FIG. 2) and a second position (fitting completion position illustrated in FIG. 3). At the first position, the connector 11 is allowed to be moved with respect to the mating connector 51 to be fitted to and released from the mating connector 51. At the second position, the connector 11 is fixed and connected to the mating connector 51.

The housing 31 is made of a synthetic resin material and has a horizontally-long rectangular block-like shape as a whole. The housing 31 is provided with a plurality of contact receiving portions 31*f* penetrating therethrough in the fitting direction A and the removing direction B. In the contact receiving portions 31*f*, the contacts, such as socket contacts, are received in one-to-one correspondence.

The housing 31 includes an upper wall 31*a*, a lower wall 31*b*, a pair of left and right side walls 31*c* and 31*d*, and a top plate portion 33 spaced from the upper wall 31*a* in parallel thereto. Among spaces surrounded by these walls, a horizontally-long slit-like space defined between the upper wall 31*a* and the top plate portion 33 parallel to the upper wall 31*a* serves as a lever receiving portion 33*a* adapted to receive the lever 21.

The mating connector 51 includes a mating housing 52 made of a synthetic resin material and having a long frame-like shape as a whole, and a plurality of mating contacts 55, such as pin contacts, held by the mating housing 52.

The mating housing 52 includes a bottom plate portion 52*a*, a top plate portion 52*b* parallel to the bottom plate portion 52*a*, a pair of side plate portions 52*c* and 52*d* connecting the bottom plate portion 52*a* and the top plate portion 52*b*, and a rear plate portion 52*e* connected to the bottom plate portion 52*a* and the top plate portion 52*b* forward in the fitting direction A.

An area surrounded by the bottom plate portion 52*a*, the top plate portion 52*b*, the side plate portions 52*c* and 52*d*, and the rear plate portion 52*e* serves as a mating fitting portion 53 to be fitted over the connector 11. In the mating fitting portion 53, the mating contacts 55 are inserted from the outside of the rear plate portion 52*e*. In the mating fitting portion 53, mating contacting portions 55*a* of the mating contacts 55 are located.

Each of the mating contacting portions 55*a* is brought into contact with a contacting portion of the contact when the connector 11 and the mating connector 51 are fitted to each other. Outside the rear plate portion 52*e* of the mating housing 52, mating terminal portions 55*b* of the mating contacts 55 are extended so as to be connected to a circuit of the printed wiring board.

The lever 21 is made of a synthetic resin material and includes a main body 23 having a generally flat shape, and a cantilevered locking member 25 elastically deformable in a thickness direction of the lever 21, i.e., in a direction perpendicular to a plate surface or plane of the lever 21 so as to lock the lever 21 at the second position.

Figure 4:
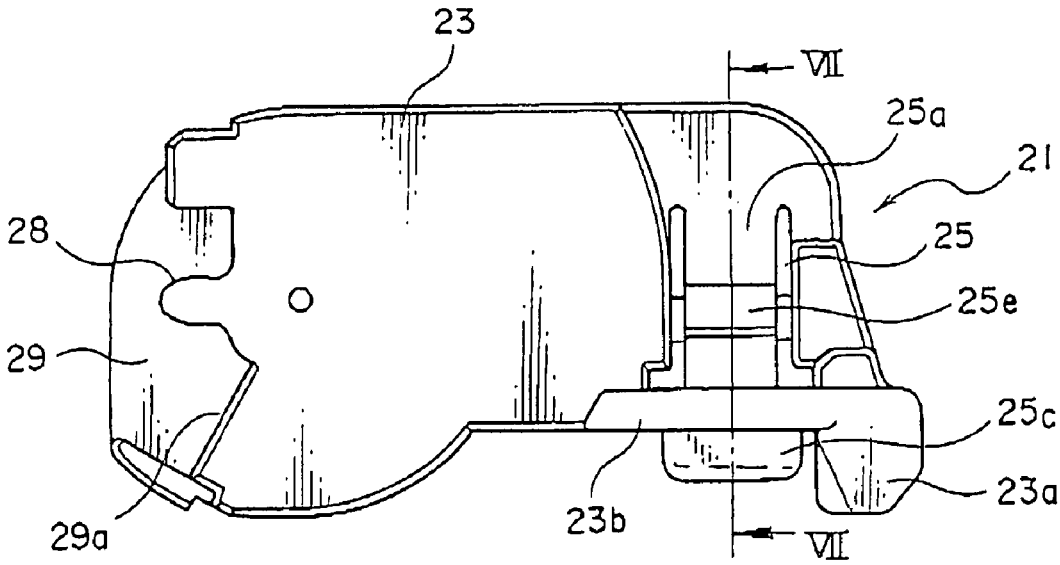
FIG. 4 is a plan view of a lever of the connector illustrated in FIGS. 1 to 3
Figure 5:
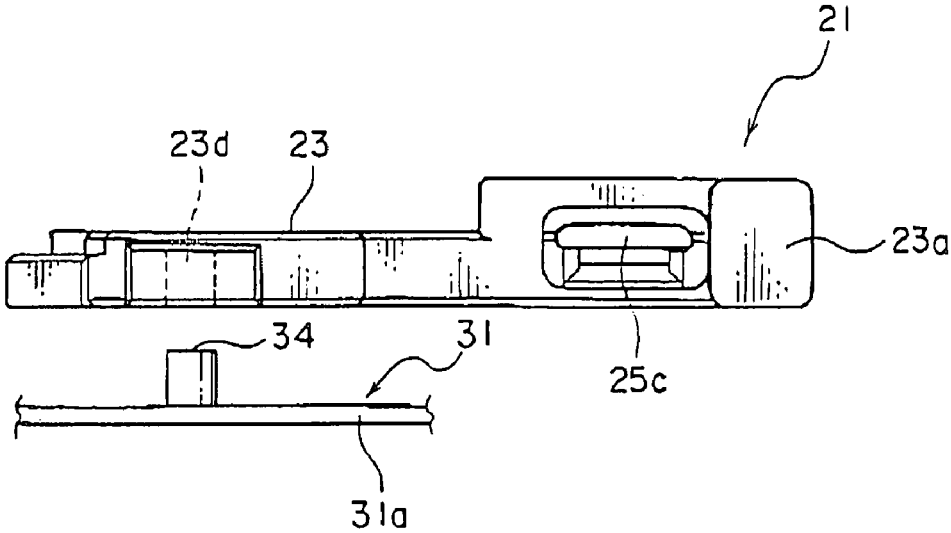
FIG. 5 is a front view of the lever illustrated in FIG. 4 together with a part of a housing of the connector.
Figure 6:
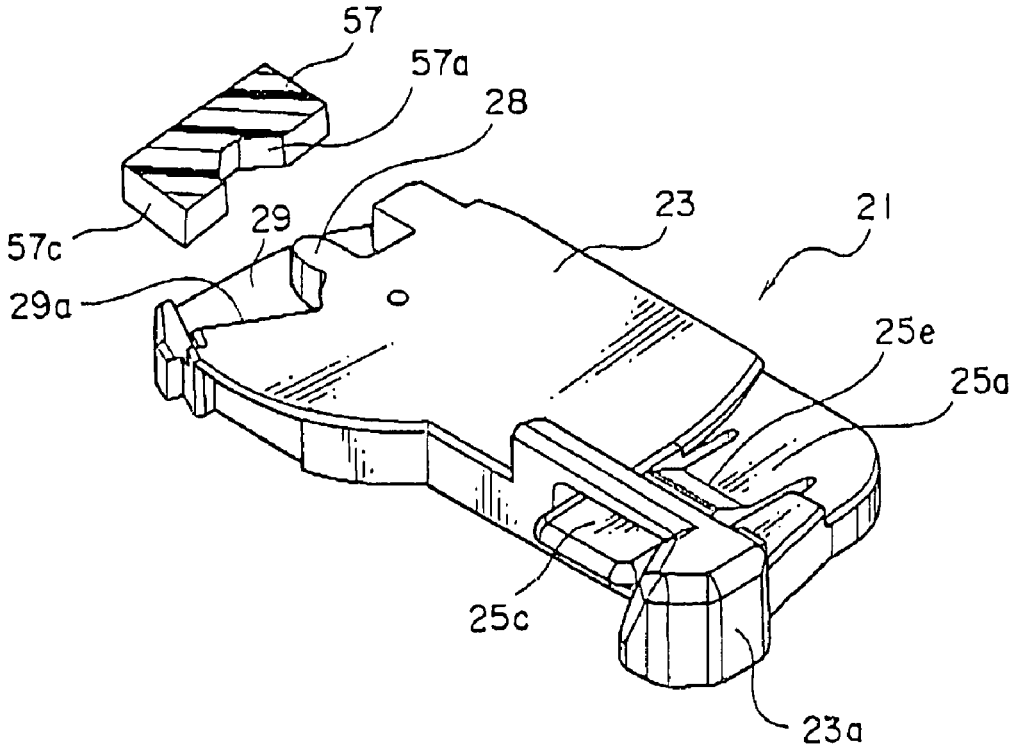
FIG. 6 is a perspective view of the lever illustrated in FIG. 4 together with a part of the mating connector.

Referring to FIGS. 4 to 6 in addition, the main body 23 is provided, near its one end, with a lever operating portion 23*a* for rotating the lever 21 and a finger placing portion 23*b* in the form of a frame having an opening formed inside. The lever operating portion 23*a* and the finger placing portion 23*b* are disposed adjacent to each other.

The main body 23 is provided with a tooth-like cam portion 28 formed at the other end and a circular bearing hole 23*d* formed near the cam portion 28. The bearing hole 23*d* is fitted over a support shaft 34 (see FIG. 5) protruding from the upper wall 31*a* of the housing 31. The lever 21 is horizontally rotatable around the support shaft 34.

In the state where the lever 21 is coupled to the housing 31, the lever 21 is located along one wall (herein, the upper wall 31*a*) of the housing 31. The cam portion 28 is received in the lever receiving portion 33*a* in the state that it is interposed between the upper wall 31*a* and the top plate portion 33 with a small clearance.

The cam portion 28 has a lower surface provided with a rotation guide groove 29. A mating cam portion 57 (see FIGS. 1 and 6) protrudes from an under surface of the top plate portion 52*b* of the mating housing 52 towards the mating fitting portion 53 and is inserted in the rotation guide groove 29. At this time, the cam portion 28 is engaged with a cam groove 57*a* of the mating cam portion 57. The lever 21 has a rotatable range defined by the mating cam portion 57 and the rotation guide groove 29 and is rotatable between the first and the second positions.

The locking member 25 of the lever 21 is integrally formed with the one end of the main body 23 and extends along the plate surface of the lever 21. The locking member 25 has a spring portion 25*a* formed at the center in a longitudinal direction, an operating portion 25*c* formed at a free end of the locking member 25, and a protruding locking portion 25*e* formed at a first portion of the spring portion 25*a*.

Figure 7:
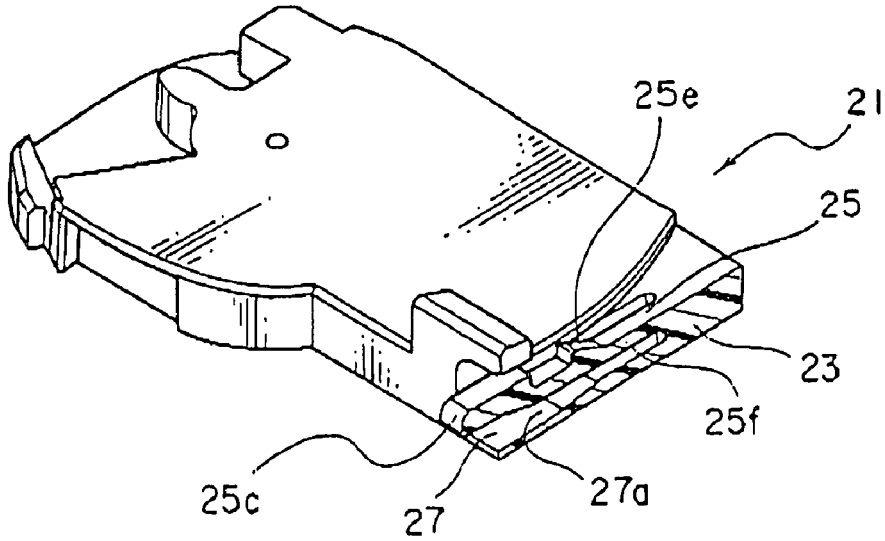
FIG. 7 is a sectional perspective view taken along a line VII-VII in FIG. 4.
Figure 8:
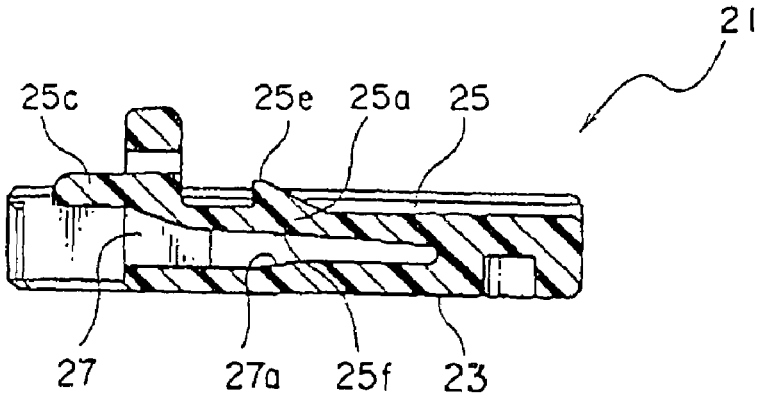
FIG. 8 is a side sectional view taken along the line VII-VII in FIG. 4.

As illustrated in FIGS. 7 and 8, the lever 21 is provided with a groove-like recess 27. In the recess 27, the locking member 25 is arranged so that a first bottom portion 25*f* is faced to a second bottom portion 27*a* in a displacement direction. In other words, the spring portion 25*a* faces a bottom of the recess 27 with a distance which is greater at a second portion between a free end of the spring portion 25*a* and the first portion thereof than a distance at the first portion of the spring portion 25*a*.

The recess 27 is formed so that, in the displacement direction of the locking member 25, a distance between the first bottom portion 25*f* and the second bottom portion 27*a* is greater on the side of the spring portion 25*a* provided with the locking portion 25*e* than on the side provided with the operating portion 25*c*.

The operating portion 25*c* passes through the opening of the finger placing portion 23*b* in order to operate the locking member 25 for unlocking a locked state. The locking portion 25*e* serves to lock the lever 21 to the mating housing 52 at the second position.

Figure 9:
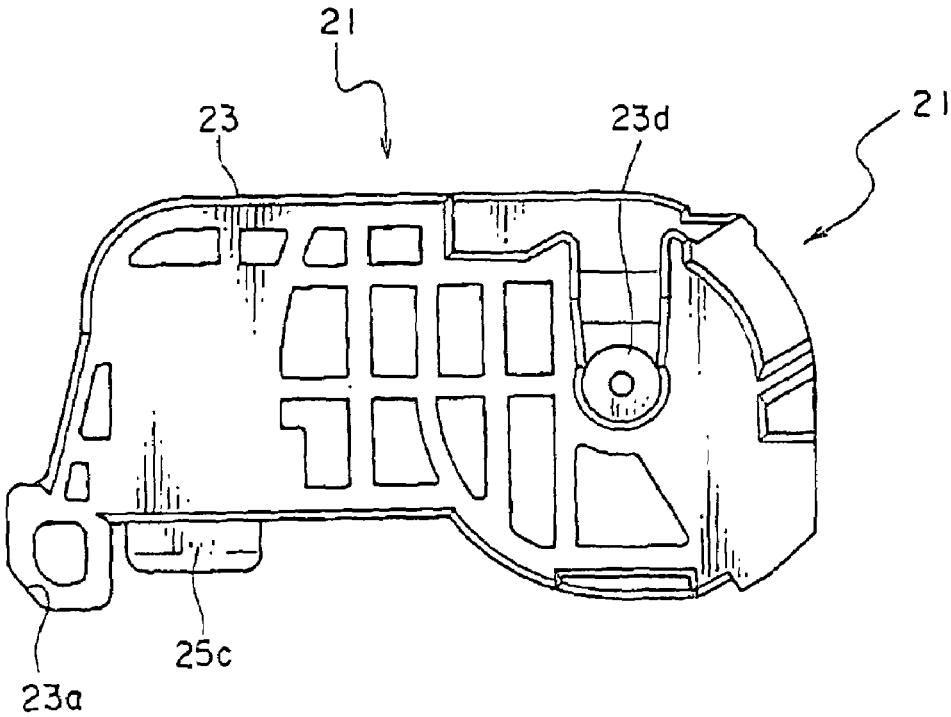
FIG. 9 is a bottom view of the lever illustrated in FIG. 4.
Figure 10:
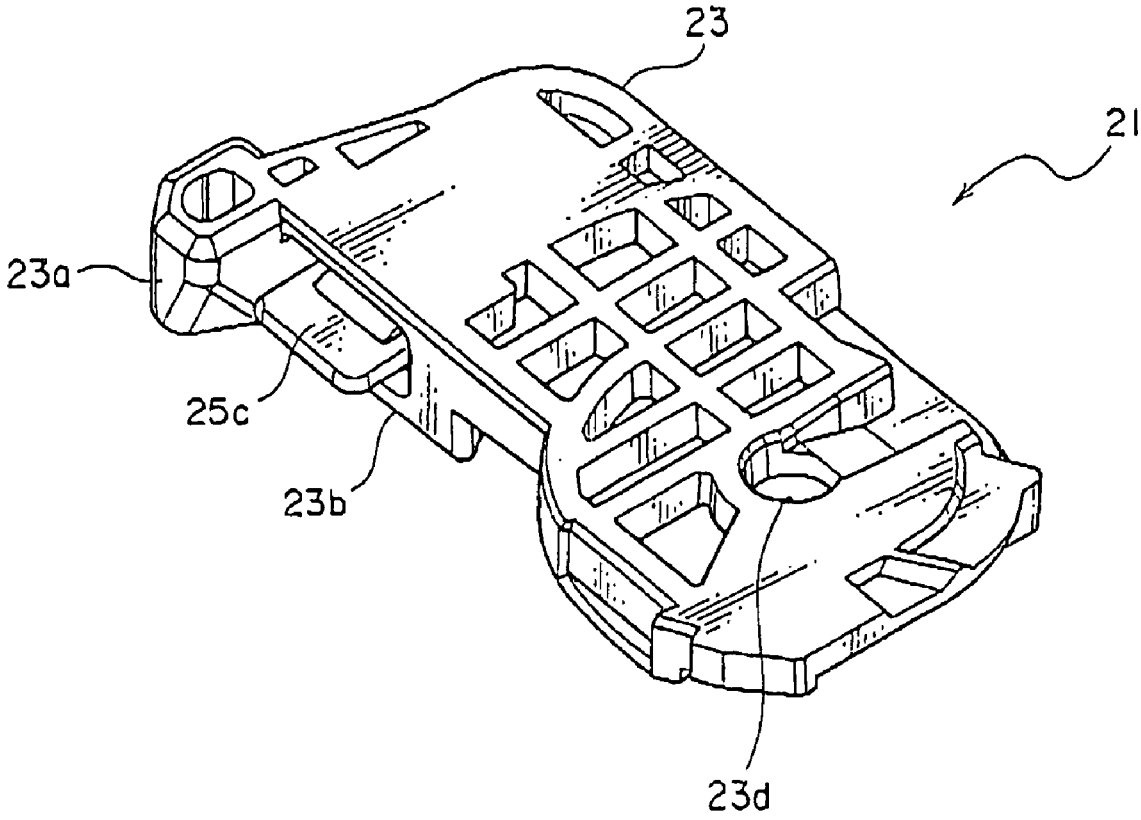
FIG. 10 is a perspective view of the lever illustrated in FIG. 4.

Referring to FIGS. 9 and 10, the lever 21 is seen from a bottom side. As will be understood from FIGS. 9 and 10, the lever 21 has a plate-like portion forming the second bottom portion 27*a* of the recess 27 (see FIGS. 7 and 8).

Thus, a lower part of the locking member 25 is covered by the plate-like portion via the recess 27. Therefore, even if the lever operating portion 23*a* is pressed and operated, the lever operating portion 23*a* is prevented from being deformed. It is therefore possible to reliably transmit an operating force. In particular, in case where the connector 11 has a large number of contacts and the lever 21 is therefore increased in size, it is possible to improve flapping strength.

In order to assemble the connector 11, the lever 21 is inserted into the lever receiving portion 33*a* and the bearing hole 23*d* is engaged with the support shaft 34. As a consequence, the lever 21 is rotatably held by the housing 31.

The connector 11 is fitted to the mating connector 51 in the following manner. At first, in the state where the lever 21 is pulled out, the connector 11 is inserted into the mating fitting portion 53. The lever 21 is located at the first position so that a rotation guide wall 29*a* adjacent to the cam portion 28 is brought into contact with a front surface 57*c* of the mating cam portion 57 in the removing direction B.

Next, by pressing the lever operating portion 23 of the lever 21, the lever 21 is rotated from the first position in FIG. 2 to the second position in FIG. 3 in a counterclockwise direction depicted by an arrow C in FIG. 2. At this time, the cam portion 28 and the cam groove 57*a* of the mating cam portion 57 are engaged with each other to cause a cam action. By the cam action, the connector 11 and the mating connector 51 are pulled towards each other and insertion of the connector 11 into the mating fitting portion 53 progresses. During the fitting operation, the lever 21 is applied with a force based on a fitting resistance. However, because the cam portion 28 is received in the lever receiving portion 33*a* and sandwiched on both sides in the thickness direction, the cam portion 28 is prevented from being deformed towards a direction parallel to a rotation axis thereof and from being released from the support shaft 34.

When the lever 21 approaches the second position, the locking portion 25*e* of the locking member 25 is brought into contact with a claw portion 52*f* (see FIG. 1) protruding from the inner surface of the top plate portion 52*b* so that the locking member 25 is elastically deformed. When the lever 21 reaches the second position, the locking member 25 is returned to its original state. The locking portion 25*e* and the claw portion 52 are engaged with each other so that the lever 21 is locked. As a consequence, the connector 11 and the mating connector 51 are put into a normal fitting state. Thus, fitting between the connector 11 and the mating connector 51 is completed.

In order to remove the connector 11 from the fitted state with the mating connector 51, an operator places his finger on the finger placing portion 23*b* and presses the operating portion 25*c* of the locking member 25 downward by a fingertip of his finger to unlock the locked state. Then, the lever operating portion 23*a* is pulled to rotate the lever 21 in a clockwise direction. As a consequence, following the rotation of the lever 21, the cam portion 28 and the mating cam portion 57 interact with each other so that the connector 11 is separated from the mating connector 51. The lever 21 reaches the first position illustrated in FIG. 2 and the cam portion 28 is disengaged from the mating cam portion 57. Then, the connector 11 is removed from the mating connector 51.

As described above, the lever 21 has a plate-like shape and is therefore reduced in thickness. The locking member 25 is formed along the plate surface of the lever 21 and elastically deformed in a direction perpendicular to the plate surface. Therefore, without increasing the thickness of the lever 21, an area of the operating portion 25*c* can be widened so that operability of the unlocking operation can be assured.

At the one end of the lever 21, the finger placing portion 23*b* and the lever operating portion 23*a* are disposed adjacent to each other. Therefore, it is possible to simply perform the unlocking operation by a single hand.

The above-mentioned connector is applicable to a part required to suppress vibration or vibration noise due to the nature of a mounting area, a vehicle wire harness attached to an unseen or invisible portion, and so on.

A second exemplary embodiment of the invention is a connector, wherein the housing has a lever receiving potion which is a slit-like space, and the lever is received in the lever receiving portion.

A third exemplary embodiment of the invention is a connector, wherein the housing has a plurality of contact receiving portions, and the contact receiving portions receives a plurality of conductive contacts in one-to-one correspondence.

A fourth exemplary embodiment of the invention is a connector, wherein the housing comprises an upper wall, a lower wall, a pair of side walls, and a top plate portion faced to and spaced from the upper wall, wherein the lever receiving portion is defined between the upper wall and the top plate portion.

A fifth exemplary embodiment of the invention is a connector, wherein the main body has one end provided with a finger placing portion, the spring portion has a lever operating portion at the free end, and the finger placing portion and the lever operating portion are positioned adjacent to each other.

A sixth exemplary embodiment of the invention is a connector, wherein the main body has a cam portion formed at the other end and a circular bearing hole formed near the cam portion, the housing comprises a support shaft fitted in the bearing hole, and the lever is rotatable around the support shaft.

A seventh exemplary embodiment of the invention is a connector, wherein the cam portion has a rotation guide groove determining the first and the second positions.

An exemplary advantage according to this invention is that the lower part of the locking member is covered by the plate-like portion via the recess. Therefore, even if the lever operating portion is pressed and operated, the lever operating portion is prevented from being deformed. It is therefore possible to reliably transmit the operating force. In particular, in case where the connector has a large number of contacts and the lever is therefore increased in size, it is possible to improve flapping strength.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector comprising:

a housing adapted to be fitted to a mating connector; and a lever held by the housing and rotatable between a first position where the housing is capable of being fitted to and released from the mating connector and a second position where the housing is fitted to the mating connector;

wherein the lever comprises:

a main body having a generally flat shape and provided with a recess which is recessed from a principal surface of the main body in a thickness direction to have a bottom portion;

a spring portion which extends from the main body in the recess to have a free end and which is elastically deformable in the thickness direction; and a locking portion which is formed to the spring portion at a first portion away from the free end and which is adapted to be locked with the housing when the lever is at the second position;

wherein the spring portion faces the bottom of the recess with a distance which is greater at a second portion between the free end and the first portion than that at the first portion.

2. The connector according to claim 1, wherein the housing has a lever receiving potion which is a slit-like space, and the lever is received in the lever receiving portion.

3. The connector according to claim 2, wherein the housing has a plurality of contact receiving portions, and the contact receiving portions receives a plurality of conductive contacts in one-to-one correspondence.

4. The connector according to claim 3, wherein the housing comprises:

an upper wall;

a lower wall;

a pair of side walls; and a top plate portion faced to and spaced from the upper wall;

wherein the lever receiving portion is defined between the upper wall and the top plate portion.

5. The connector according to claim 1, wherein the main body has one end provided with a finger placing portion, the spring portion has a lever operating portion at the free end, and the finger placing portion and the lever operating portion are positioned adjacent to each other.

6. The connector according to claim 5, wherein the main body has a cam portion formed at the other end and a circular bearing hole formed near the cam portion, the housing comprises a support shaft fitted in the bearing hole, and the lever is rotatable around the support shaft.

7. The connector according to claim 6, wherein the cam portion has a rotation guide groove determining the first and the second positions.

* * * * *